US006919040B2

(12) United States Patent
Fries et al.

(10) Patent No.: US 6,919,040 B2
(45) Date of Patent: Jul. 19, 2005

(54) METHOD OF PRODUCING AN ABRASIVE PRODUCT CONTAINING CUBIC BORON NITRIDE

(76) Inventors: Robert Fries, 4 Birnam Road, Forest Town, 2001, Johannesburg (ZA); Peter Michael Harden, 2 Dulcie Close, Lonehill, 2062, Sandton (ZA)

( * ) Notice: Subject to any disclaimer, the term of this patent is extended or adjusted under 35 U.S.C. 154(b) by 0 days.

(21) Appl. No.: 10/344,178

(22) PCT Filed: Aug. 3, 2001

(86) PCT No.: PCT/IB01/01385

§ 371 (c)(1),
(2), (4) Date: Jul. 22, 2003

(87) PCT Pub. No.: WO02/12578

PCT Pub. Date: Feb. 14, 2002

(65) Prior Publication Data

US 2004/0018108 A1 Jan. 29, 2004

(30) Foreign Application Priority Data

Aug. 8, 2000 (ZA) ..... 2000/4045

(51) Int. Cl.[7] ..... C22C 32/00
(52) U.S. Cl. ..... 419/16; 419/13
(58) Field of Search ..... 419/13, 16

(56) References Cited

U.S. PATENT DOCUMENTS 3,768,972 A * 10/1973 Taylor et al. ..... 23/300
3,918,931 A 11/1975 De Vries et al. ..... 51/309
4,525,178 A 6/1985 Hall ..... 51/309
5,045,092 A 9/1991 Keshavan ..... 51/293

FOREIGN PATENT DOCUMENTS

| | | | |
|---|---|---|---|
| EP | 256 829 | 2/1988 | ..... C22C/29/02 |
| EP | 583 916 | 2/1994 | ..... B24D/3/08 |
| EP | 774 527 | 5/1997 | ..... C22C/26/00 |
| JP | 57-116742 | 7/1982 | |

* cited by examiner

*Primary Examiner*—Daniel Jenkins
(74) *Attorney, Agent, or Firm*—Pauley Petersen & Erickson

(57) ABSTRACT

A method of producing an abrasive product consists of providing a mixture of a mass of discrete carbide particles and a mass of cubic boron nitride particles, the cubic boron nitride particles being present in the mixture in an amount such that the cubic boron nitride content of the abrasive product is 25% or less by weight, and subjecting the mixture to elevated temperature and pressure conditions at which the cubic boron nitride is crystallographically stable and at which substantially no hexagonal boron nitride is formed, in the presence of a bonding metal or alloy capable of bonding the mixture into a coherent, sintered product, to form the abrasive product. The bonding metal or alloy comprises a combination of a transition metal or a transition alloy and up to 40% by volume of the bonding metal or alloy of a second metal which is a stronger nitride or boride former than the transition metal or the transition metal alloy.

47 Claims, No Drawings

METHOD OF PRODUCING AN ABRASIVE PRODUCT CONTAINING CUBIC BORON NITRIDE

BACKGROUND TO THE INVENTION

This invention relates to a method of producing an abrasive product containing cubic boron nitride and cemented carbide.

Cemented carbide is a material which is used extensively in industry for a variety of applications, both as an abrading material and as a wear resistant material. Cemented carbides generally consist of suitable carbide particles such as tungsten carbide, tantalum carbide or titanium carbide, bonded together by means of a bonding metal such as cobalt, iron or nickel, or an alloy thereof. Typically, the metal content of cemented carbides is about 3 to 35% by weight. They are produced by sintering the carbide particles and the bonding metal at temperatures of the order of 1400° C.

At the other end of the spectrum, ultrahard abrasive and wear resistant products are found. Diamond and cubic boron nitride compacts are polycrystalline masses of diamond or cubic boron nitride particles, the bonding being created under conditions of elevated temperature and pressure at which the ultrahard component, i.e the diamond or cubic boron nitride, is crystallographically stable. Polycrystalline diamond (PCD) and polycrystalline cubic boron nitride (PCBN) can be produced with or without a second phase or bonding matrix. The second phase, when provided, may be, in the case of diamond, a catalyst/solvent such as cobalt, or may be a carbide forming element such as silicon. Similar sintering mechanisms are utilised in PCBN synthesis with various carbides, nitrides and borides being common second phases.

PCD and PCBN have a far higher wear resistance than cemented carbides, but tend to be somewhat brittle. This brittleness can lead to edge chipping of the working surface which can present a problem in applications where fine finishes are required. Furthermore, ultrahard products such as PCD and PCBN can generally not be directly brazed onto a metallic support. They are therefore often sintered in combination with a cemented carbide substrate. The bi-layered nature of such ultrahard products can be problematic in terms of thermo-mechanical stresses between the two materials: differential expansion and shrinkage on heating and cooling due to different thermal expansion coefficients and elastic moduli can lead to crack formation or unfavourable residual stresses if the substrate and the ultrahard products are too dissimilar. Another potential problem of such bi-layered materials is that of undercutting, i.e. preferential wear of the less abrasion resistant carbide support. Further, machining of ultrahard products is difficult and costly, where carbide products can be relatively easily ground to the final geometry.

Efforts have been made to solve some of these problems.

JP-A-57 116 742 discloses the preparation of a modified cemented carbide under hot pressing conditions, i.e. temperatures of the order of 1400° C. to 1500° C. with little or no pressure being applied. These are not conditions at which cubic boron nitride is crystallographically stable.

European Patent No 0 256 829 describes a method of producing an abrasive and wear resistant material comprising a mass of carbide particles, a mass of cubic boron nitride particles and a bonding metal or alloy bonded into a coherent, sintered form, the cubic boron nitride particle content of the material not exceeding 20% by weight and the material being substantially free of hexagonal boron nitride, which comprises contacting appropriate amounts of a mass of carbide particles and a mass of cubic boron nitride particles with a bonding metal or alloy and sintering the particles and metal or alloy under temperature and pressure conditions at which the cubic boron nitride is crystallographically stable.

SUMMARY OF THE INVENTION

According to the invention there is provided a method of producing an abrasive product comprising:

(1) providing a mixture of a mass of discrete carbide particles and a mass of cubic boron nitride particles, the cubic boron nitride particles being present in the mixture in an amount such that the cubic boron nitride content of the abrasive product is 25% or less by weight; and (2) subjecting the mixture to elevated temperature and pressure conditions at which the cubic boron nitride is crystallographically stable and at which substantially no hexagonal boron nitride is formed, in the presence of a bonding metal or alloy capable of bonding the mixture into a coherent, sintered product, wherein the bonding metal or alloy comprises a combination of:

(a) a transition metal or a transition metal alloy, preferably cobalt, iron or nickel, or alloys thereof; and (b) from greater than 0% up to 40% by volume of the bonding metal or alloy (i.e. metal (a) plus metal (b)) of a second metal which is a stronger nitride and/or boride former than the transition metal or the transition metal alloy, or an alloy of the second metal;

to produce the abrasive product.

The metal (b) is preferably selected from the group consisting of aluminium, silicon, titanium, zirconium, molybdenum, niobium, tungsten, vanadium, hafnium, tantalum, chromium, magnesium, calcium, barium, ytrium, beryllium, cerium, strontium, thorium, lanthanum and lithium.

The preferred metal (b) is selected from the group consisting of silicon, aluminium and titanium.

Preferably, the bonding metal or alloy comprises from 60% to 99.5% by volume of the metal (a) and from 0.5% to 40% inclusive by volume of the metal (b).

The metal (a) is preferably provided in powdered form, but may also be added in the form of an organic precursor or salt precursor that is subsequently pyrolised to result in finely dispersed metal.

The metal (b) may be provided in powdered form but may also be added in the form of an organic precursor or salt precursor. Additionally, the metal (b) may be provided in the form of a non-stoichiometric carbide, nitride or boride or in the form of a stoichiometric carbide, nitride or boride where this is sufficiently soluble in the metal (a) such that metal (b) can migrate through metal (a).

The metals (a) and (b) may also be provided in the form of an alloy of the metals (a) and (b).

The bonding metal or alloy, e.g. the metals (a) and (b) may be mixed with the carbide particles and with the cubic boron nitride particles and the mixture may then be sintered as such, or the mixture may first be cold-pressed to produce a weak but coherent body prior to sintering.

Alternatively, the bonding metal or alloy, e.g. the metals (a) and (b) may be supplied in the form of a separate layer adjacent to the cubic boron nitride-carbide mixture and infiltrated during the high temperature/high pressure treatment step.

The cubic boron nitride particles are preferably present in the mixture in an amount such that the cubic boron nitride content of the abrasive product is from 10% to 18% inclusive by weight.

The cubic boron nitride particles may be fine or coarse. The cubic boron nitride particles preferably have a particle size in the range of from 0,2 μm to 70 μm inclusive, preferably less than 20 μm, more preferably less than 10 μm.

The bonding metal or alloy is preferably used in an amount of from 2% to 20% inclusive by weight of the abrasive product, more preferably from 5% to 20% inclusive by weight of the abrasive product, most preferably less than 15% by weight of the abrasive product.

The carbide particles may be any carbide particles used in the manufacture of conventional cemented carbides. Examples of suitable carbides are tungsten carbide, tantalum carbide, titanium carbide and mixtures of two or more thereof.

The carbide particles preferably have a particle size in the range of from 0,1 μm to 10 μm inclusive.

The sintering of the mixture of carbide and cubic boron nitride particles and the bonding metal or alloy preferably takes place at a temperature in the range of from 1200° C. to 1600° C. inclusive, and at a pressure from 30 to 70 kbar inclusive.

This step is preferably carried out under controlled non-oxidising conditions.

The sintering of the mixture of carbide and cubic boron nitride particles and the bonding metal or alloy may be carried out in a conventional high temperature/high pressure apparatus. The mixture may be loaded directly into the reaction capsule of such an apparatus. Alternatively, the mixture may be placed on a cemented carbide support or a recess formed in a carbide support, and loaded in this form into the capsule.

In a preferred method of the invention, the carbide particles, the cubic boron nitride particles and the bonding metal or alloy have volatiles removed from them prior to sintering, e.g. by heating them in a vacuum. These components are preferably then vacuum sealed by, for example, electron beam welding prior to sintering. The vacuum may, for example, be a vacuum of 1 mbar or less and the heating may be a temperature in the range of 500° C. to 1200° C. inclusive.

The abrasive product produced by the method of the invention may be used as an abrasive product for abrading materials, or as a wear resistant material, particularly in tool components or inserts which consist of an abrasive compact bonded to a cemented carbide support. Typical applications include the cutting of wood and construction materials as well as the machining of various metallic work pieces such as stainless steel, nodular cast irons and superalloys.

DESCRIPTION OF EMBODIMENTS

The crux of the invention is a method of producing an abrasive product by providing a mixture of a mass of discrete carbide particles and a mass of cubic boron nitride particles, and subjecting the mixture to elevated temperature and pressure conditions at which the cubic boron nitride is crystallographically stable and at which substantially no hexagonal boron nitride is formed, in the presence of a bonding metal or alloy capable of bonding the mixture into a coherent, sintered product. The cubic boron nitride particles are present in the mixture in an amount such that the cubic boron nitride content of the abrasive product is 25% or less by weight, preferably in the range of from 10% to 18% inclusive by weight.

The bonding metal or alloy comprises a combination of:

(a) a transition metal or a transition metal alloy, preferably cobalt, iron or nickel, or alloys thereof;

(b) from greater than 0% up to 40% by volume of the bonding metal or alloy of a second metal which is a stronger nitride or boride former than the transition metal or transition metal alloy, or an alloy of the second metal.

The abrasive product produced is, in effect, a cemented carbide which has been modified by the addition of cubic boron nitride particles. The addition of these particles provides the cemented carbide with greater abrasive and wear resistant properties.

The abrasive product produced must be substantially free of hexagonal boron nitride. The presence of any significant quantity of hexagonal boron nitride reduces the abrasive wear resistant properties of the product. In producing the product, it is important that conditions are chosen which achieve this.

The sintering step is carried out in the presence of a bonding metal or alloy which comprises a combination of (a) a transition metal or transition metal alloy and (b) from greater than 0% up to 40% by volume of the bonding metal or alloy of a second metal which is a stronger nitride or boride former than the transition metal or transition metal alloy, or an alloy of this second metal.

As the boride or nitride forming metals tend to react with the cubic boron nitride particles, high amounts of such metals can result in excessive loss of the cubic boron nitride phase and the formation of a high proportion of undesirable brittle phases. Thus, metal (b) is used in an amount up to 40% by volume of the bonding metal or alloy, i.e. the total metal content, and this has been found sufficient to achieve a highly wear resistant product.

The presence of the metal (b) leads to improved bonding of the cubic boron nitride grains to the carbide matrix and thus to an improvement in the properties of the abrasive product produced.

The invention will now be described in more detail with reference to the following examples.

EXAMPLE 1 (COMPARATIVE EXAMPLE)

A powder mixture of 10,6 wt % cubic boron nitride, 79,6 wt % tungsten carbide and 9,8 wt % cobalt, all in the size range 1 to 2 micron, was thoroughly mixed in a planetary ball mill to achieve a homogeneous blend of the materials. The blend was uniaxially compacted to form a coherent pellet. The pellet was loaded into a metal canister and subsequently outgassed under vacuum at 1100° C. and sealed by electron beam welding. The sealed containers were loaded into the reaction capsule of a standard high pressure/high temperature apparatus and the loaded capsules placed into the reaction centre of this apparatus. The contents of the capsule were exposed to a temperature of approximately 1450° C. and a pressure of 50 kbar. These conditions were maintained for 10 minutes. After completion of the treatment a well-sintered, hard and wear resistant material was recovered from the canister.

The abrasion resistance of the material was tested using a turning test where silica flour filled epoxy resin was machined using the following conditions:

| | |
|---|---|
| Sample format: | 90° quadrant 3.2 mm thick |
| Tool holder: | neutral |
| Rate angle: | 0° |
| Clearance angle: | 6° |
| Cutting speed: | 10 m/min |
| Depth of cut: | 1.0 mm |
| Feed rate: | 0.3 mm/rev |
| Test duration: | 60 s |

Under the given conditions the material exhibited a maximum flank wear width of 0,17 mm.

EXAMPLE 2

In order to assess the benefit of a nitride and boride forming additive the following mix was prepared using the method of Example 1:

10,6 wt % cubic boron nitride 79,6 wt % tungsten carbide 9,2 wt % cobalt 0,6 wt % aluminium Using the same turning test as in Example 1 the material showed a maximum flank wear width of 0,14 mm.

What is claimed is:

1. A method of producing an abrasive product comprising the steps of:

(1) providing a mixture including a mass of discrete carbide particles and a mass of cubic boron nitride particles, the cubic boron nitride particles being present in the mixture in an amount such that the cubic boron nitride content of the abrasive product is 25% or less by weight; and (2) subjecting the mixture to elevated temperature and pressure conditions at which the cubic boron nitride is crystallographically stable and at which substantially no hexagonal boron nitride is formed, in the presence of a bonding metal or alloy capable of bonding the mixture into a coherent, sintered product, wherein the bonding metal or alloy comprises a combination of:

(a) a transition metal or a transition metal alloy; and (b) from greater than 0% up to 40% by volume of the bonding metal or alloy of a second metal which is not a carbide and is a stronger nitride or boride former than the transition metal or the transition metal alloy, or an alloy of the second metal;

to produce the abrasive product.

2. A method according to claim 1 wherein the transition metal is selected from the group consisting of cobalt, iron, nickel, and combinations thereof.

3. A method according to claim 1 wherein the second metal (b) is selected from the group consisting of aluminium, silicon, titanium, zirconium, molybdenum, niobium, tungsten, vanadium, hafnium, tantalum, chromium, magnesium, calcium, barium, yttrium, beryllium, cerium, strontium, thorium, lanthanum, lithium, and combinations thereof.

4. A method according to claim 3 wherein the second metal (b) is selected from the group consisting of silicon, aluminium, titanium, and combinations thereof.

5. A method according to claim 1 wherein the bonding metal or alloy comprises from 60% to 99.5% inclusive by volume of the metal (a) and from 0.5% to 40% inclusive by volume of the metal (b).

6. A method according to claim 1 wherein the metal (a) is provided in a form selected from powdered form and the form of an organic precursor or salt precursor that is subsequent pyrolised to result in finely dispersed metal.

7. A method according to claim 1 wherein the metal (b) is provided in a form selected from powder form; the form of an organic precursor or salt precursor; the form of a non-stoichiometric nitride or boride; and the form of a stoichiometric nitride or boride in the metal (a).

8. A method according to claim 1 wherein the metal (a) and the metal (b) are provided in the form of an alloy of the metal (a) with the metal (b).

9. A method according to claim 1 wherein in step (1) the bonding metal or alloy is mixed with the carbide particles and with the cubic boron nitride particles, and in step (2) the mixture is subjected to the elevated temperature and pressure conditions.

10. A method according to claim 1 wherein in step (1) the bonding metal or alloy is mixed with the carbide particles and with the cubic boron nitride particles, and the mixture is cold-pressed to produce a weak coherent body, and in step (2) the weak coherent body is subjected to the elevated temperature and pressure conditions.

11. A method according to claim 1 wherein in step (1) the bonding metal or alloy is supplied in the form of a separate layer adjacent to the mixture of the mass of carbide particles and the mass of cubic boron nitride particles, and in step (2) the bonding metal or alloy is infiltrated when the mixture is subjected to the elevated temperature and pressure conditions.

12. A method according to claim 1 wherein the cubic boron nitride particles are present in the mixture in an amount such that the cubic boron nitride content of the abrasive product is from 10% to 18% inclusive by weight.

13. A method according to claim 1 wherein the cubic boron nitride particles have a particle size in the range of from 0.2 $\mu$m to 70 $\mu$m inclusive.

14. A method according to claim 1 wherein the bonding metal or alloy is used in an amount of from 2% to 20% inclusive by weight of the abrasive product.

15. A method according to claim 1 wherein the carbide particles are selected from the group consisting of tungsten carbide particles, tantalum carbide particles, titanium carbide particles, and mixtures of two or more thereof.

16. A method according to claim 1 wherein the carbide particles have a particle size in the range of from 0.1 $\mu$m to 10 $\mu$m inclusive.

17. A method according to claim 1 wherein in step (2) the elevated temperature and pressure conditions are a temperature in the range of from 1200° C. to 1600° C. inclusive and a pressure of from 30 kbar to 70 kbar inclusive.

18. A method according to claim 1 wherein step (2) is carried out under controlled non-oxidising conditions.

19. A method according to claim 2 wherein the second metal (b) is selected from the group consisting of aluminium, silicon, titanium, zirconium, molybdenum, niobium, tungsten, vanadium, hafnium, tantalum, chromium, magnesium, calcium, barium, yttrium, beryllium, cerium, strontium, thorium, lanthanum, lithium, and combinations thereof.

20. A method according to claim 19 wherein the second metal (b) is selected from the group consisting of silicon, aluminium, titanium, and combinations thereof.

21. A method according to claim 20 wherein the bonding metal or alloy comprises from 60% to 99.5% inclusive by volume of the metal (a) and from 0.5% to 40% inclusive by volume of the metal (b).

22. A method according to claim 21 wherein the cubic boron nitride particles are present in the mixture in an amount such that the cubic boron nitride content of the abrasive product is from 10% to 18% inclusive by weight.

23. A method according to claim 22 wherein the cubic boron nitride particles have a particle size in the range of from 0.2 μm to 70 μm inclusive.

24. A method according to claim 23 wherein the bonding metal or alloy is used in an amount of from 2% to 20% inclusive by weight of the abrasive product.

25. A method according to claim 24 wherein the carbide particles are selected from the group consisting of tungsten carbide particles, tantalum carbide particles, titanium carbide particles, and mixtures of two or more thereof.

26. A method according to claim 25 wherein the carbide particles have a particle size in the range of from 0.1 μm to 10 μm inclusive.

27. A method of producing an abrasive product comprising:

(1) providing a mixture including discrete carbide particles and cubic boron nitride particles, the cubic boron nitride particles being present in an amount such that the abrasive product has a cubic boron nitride content of about 10–18% by weight; and (2) subjecting the mixture to elevated temperature and pressure conditions at which the cubic boron nitride is crystallographically stable and at which substantially no hexagonal boron nitride is formed, in the presence of a bonding metal or alloy which comprises a combination of:

(a) a first metal selected from the group consisting of a transition metal and a transition metal alloy; and (b) from 05% up to 40% by volume of the bonding metal or alloy of a second metal which is not a carbide and is selected from the group consisting of aluminum, silicon, titanium, zirconium, molybdenum, niobium, tungsten, vanadium, hafnium, tantalum, chromium, magnesium, calcium, barium, yttrium, beryllium, cerium, strontium, thorium, lanthanum, lithium, and alloys thereof;

to produce the abrasive product.

28. The method of claim 27, wherein the transition metal is selected from the group consisting of cobalt, iron, nickel, and combinations thereof.

29. The method of claim 27, further comprising the step of providing the first metal in powdered form.

30. The method of claim 27, further comprising the step of providing the first metal in the form of a pyrolised organic precursor or salt precursor.

31. The method of claim 27, further comprising the step of providing the second metal in powdered form.

32. The method of claim 27, further comprising the step of providing the second metal in the form of an organic precursor or salt precursor.

33. The method of claim 27, further comprising the step of providing the second metal in the form of a nitride or boride that is soluble in the first metal.

34. The method of claim 27, wherein the elevated temperature is about 1200–1600° C.

35. The method of claim 27, wherein the elevated pressure is about 40–70 kbar.

36. The method of claim 27, wherein the carbide particles are selected from the group consisting of tungsten carbide particles, tantalum carbide particles, titanium carbide particles, and combinations thereof.

37. The method of claim 27, wherein the bonding metal or alloy constitutes about 2–20% by weight of the abrasive product.

38. A method of producing an abrasive product comprising:

(1) providing a mixture including carbide particles having a particle size of about 0.1–10 microns and cubic boron nitride particles having a particle size of about 0.2–70 microns, the cubic boron nitride particles being present in an amount such that the abrasive product has a cubic boron nitride content of up to about 25% by weight; and (2) sintering the mixture at a temperature of about 1200–1600° C. and a pressure of about 40–70 kbar in the presence of a bonding metal or alloy which comprises a combination of:

(a) a first metal selected from the group consisting of a transition metal and a transition metal alloy; and (b) from greater than 0% up to 40% by volume of the bonding metal or alloy of a second metal which is not a carbide and is selected from the group consisting of aluminum, silicon, titanium, zirconium, molybdenum, niobium, tungsten, vanadium, hafnium, tantalum, chromium, magnesium, calcium, barium, yttrium, beryllium, cerium, strontium, thorium, lanthanum, and lithium, and alloys thereof;

to produce the abrasive product.

39. The method of claim 38, wherein the abrasive article has a cubic boron nitride content of about 10–18% by weight.

40. The method of claim 38, wherein the cubic boron nitride particles have a particle size of less than about 20 microns.

41. The method of claim 38, wherein the cubic boron nitride particles have a particle size of less than about 10 microns.

42. The method of claim 38, wherein the sintering is performed under controlled non-oxidising conditions.

43. The method of claim 38, further comprising the step of removing volatiles from the carbide particles, cubic boron nitride particles, and bonding metal or alloy prior to sintering.

44. The method of claim 43, wherein the volatiles are removed by applying a vacuum pressure of about 1 mbar or less at a temperature of about 500–1200° C.

45. The method of claim 38, wherein the bonding metal or alloy constitutes about 2–20% by weight of the abrasive product.

46. The method of claim 38, wherein the bonding metal or alloy constitutes about 5–20% by weight of the abrasive product.

47. The method of claim 38, wherein the bonding metal or alloy constitutes less than about 15% by weight of the abrasive product.

* * * * *